United States Patent [19]

Pedersen et al.

[11] Patent Number: 4,593,629

[45] Date of Patent: Jun. 10, 1986

[54] SOLID FUEL STOKER

[75] Inventors: Marianne G. Pedersen, Örum, Denmark; Michael Vaughan, Co. Meath, Ireland

[73] Assignee: Maskinfabrikken Dan-Trim ApS, Viborg, Denmark

[21] Appl. No.: 638,968

[22] PCT Filed: Dec. 7, 1983

[86] PCT No.: PCT/DK83/00114

§ 371 Date: Jul. 31, 1984

§ 102(e) Date: Jul. 31, 1984

[87] PCT Pub. No.: WO84/02385

PCT Pub. Date: Jun. 21, 1984

[30] Foreign Application Priority Data

Dec. 8, 1982 [DK] Denmark ..... 5443/82

[51] Int. Cl.[4] ..... F23J 1/02

[52] U.S. Cl. ..... 110/172; 110/110

[58] Field of Search ..... 110/318, 319, 110, 268, 110/267, 327, 101 R, 172

[56] References Cited

U.S. PATENT DOCUMENTS

| | | | |
|---|---|---|---|
| 454,037 | 6/1891 | Edgar | 110/319 |
| 1,315,158 | 9/1919 | Risdon | 110/268 |
| 4,444,127 | 4/1984 | Spronz | 110/318 X |

*Primary Examiner*—Edward G. Favors

*Attorney, Agent, or Firm*—Antonelli, Terry & Wands

[57] ABSTRACT

A tunnel shaped stoker hearth comprises a lower U-shaped portion (42) made conventionally as a double walled steel construction having injection holes (46) for combustion air in the inner wall thereof, and a top portion (48), which is made of a ceramic material, whereby, in operation, the top portion of the tunnel hearth is kept red or white glowing for effective combustion of the fuel and the gases as escaping therefrom.

3 Claims, 4 Drawing Figures

FIG.1
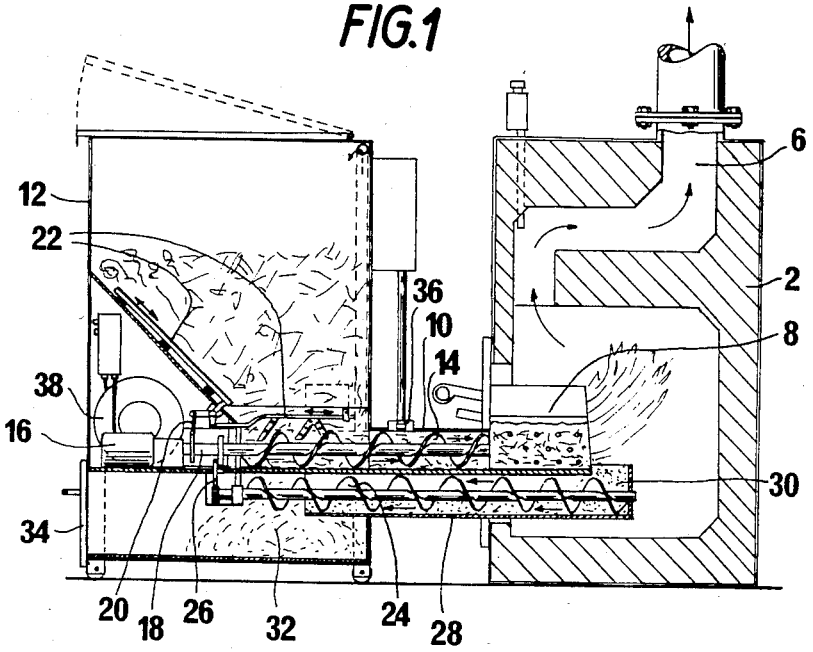
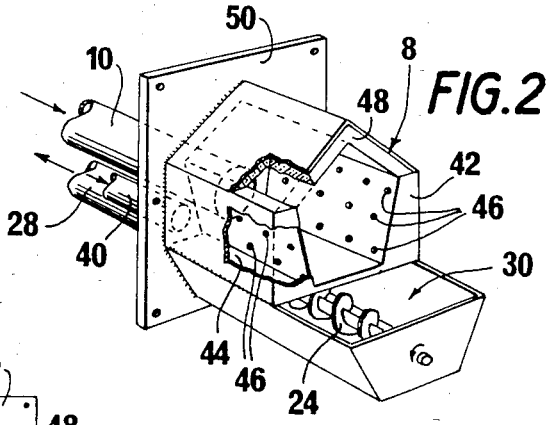
FIG.2
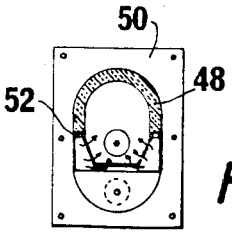
FIG.3
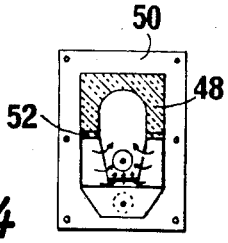
FIG.4

SOLID FUEL STOKER

The present invention relates to a solid fuel stoker as comprising a hearth, a fuel conveyor for feeding fuel to the hearth and blower means for supplying combustion air to the hearth through bottom and/or side openings therein.

Automatically stoked furnaces are used to an increasing extent, because they can handle a wide variety of solid fuels, including many types of waste material. Traditional stoker hearths are open combustion chambers, which are mountable almost as an oil burner in a furnace and receive the fuel in a continuous manner from a fuel silo, normally by means of a conveyor worm. The fuel, pushed through the chute shaped hearth, leaves the hearth as ashes, which may be collected in an ashtray underneath the inner, free end of the hearth. The bottom and/or sides of the hearth are made as a hollow double steel plate construction, the interior of which is connected with an air blower for supplying air to the combustion area through holes in the inner plate, whereby the air will also have a desired cooling effect on the hearth material.

It has been observed that, for several fuel materials, some combustible gases escape from the fuel so as to be incompletely combusted, and it has been suggested, therefore, to shape the hearth in a cylindric manner, whereby the gases are better maintained within the combustion chamber, and combustion air may even be introduced into this chamber through holes near top area of the interior cylindrical wall plate of the chamber. The combustion air will be well preheated inasfar as it moves through the annular cylindrical space of the tunnel hearth, even over a topside thereof, where the temperature is rather high. At the same time, of course, the air has the important function of cooling the top portion of the tunnel hearth, which could otherwise be exposed to overheating.

While the tunnel shape of the hearth is an improvement for holding the combustible gases inside the active burning area, it has been found that the hearth construction can nevertheless be essentially further improved, and it is the object of the invention to provide such a further improved stoker hearth.

According to the invention there is provided a hearth generally of the tunnel type, but wherein the top portion of the hearth is made of a suitable ceramic material, preferably shaped as a solid thick-walled roof member, i.e. without forming part of the combustion air supply system, while the lower part of the hearth is of a conventional hollow-wall design, in which combustion air inlet holes are provided in an inner wall portion thereof.

With this construction the ceramic and uncooled roof portion will, in operation, be heated to a relatively very high temperature, so as to normally be red- or white-glowing, and it will consequently be a powerful source of radiation heat, which will operate to ignite the fuel and all escaping combustible gases. Practical tests have demonstrated that the combustion efficiency of such a hearth is clearly better than the efficiency of the discussed known hearths.

In the following the invention is described in more detail with reference to the drawing, in which:

FIG. 1 is a general sectional side view of a stoker system according to the invention as mounted in connection with a furnace, FIG. 2 is a perspective view of the hearth of the stoker system, and FIGS. 3 and 4 are cross sectional views of modified shapes of the hearth.

As shown in FIG. 1, a furnace 2 includes a firing chamber 4 and a smoke outlet channel 6. A stoker hearth 8 is disposed forwardly of the firing chamber 4 and is connected with a fuel supply tube 10 projecting forwardly from a fuel silo 12 and housing a conveyor worm 14 driven by a motor 16. The shaft 18 of the motor 16 is operatively connected, through suitable transfer means 20, with reciprocable grate elements 22 arranged at a bottom of the silo for facilitating material supply to the worm 14, and the shaft 18 is connected with an underlying conveyor worm 24 so as to cause the latter to rotate with reduced speed, through a gear or driving pawl system 26. The lower worm 24 operates in a tube 28 stretching from a receiver area 30 beneath the free end of hearth 8 to a rear unloading area 32 in the bottom portion of the silo element 12, beneath the upper fuel holding compartment thereof. The worm 24 serves to convey ashes falling from the hearth 8 rearwardly to an ashtray 34 in the silo element 12.

The silo element 12 is a unit as provided with the protruding conveyor tubes 10, 28 and the associated hearth 8, whereby such a unit may be used in connection with any standard furnace 2, e.g. replacing an oil burner thereon. In operation the worm 14 will supply solid fuel to the hearth 8, and the resulting ashes will be dropped into the receiver area 30 and then moved rearwardly to the ashtray 34.

The system is provided with various control equipment including means for sensing a burning action in the fuel supply tube 10 and for actuating a water sprinkler valve 36 to stop backburning.

The said silo element or unit 12 further comprises a blower 38, which is connected to the hearth 8 through a blower pipe 40 (FIG. 2).

The hearth itself (see FIG. 2) is made of a lower portion 42, which is generally U-shaped and is a double steel plate construction having an inner chamber 44 connected with the blower tube 40 and communicating with the inner space of the U-member through holes 46 in the innermost plate member thereof, and an upper roof portion 48, which is a thick-walled ceramic member connected with the lower hearth portion 12 in any suitable manner so as to therewith form a tunnel hearth 8. In FIG. 2 it is indicated that the roof portion 48 has an outer plate portion which is welded to a common end plate member 50, but the detailed manner of joining the ceramic roof element 48 with the lower hearth portion 42 is not of any primary importance. An outer plating on the roof element may be practical as a result of the ceramic element 48 being cast against such plating, but the ceramic element 48 may well be produced otherwise, and the outer plating is of no special operative significance. As mentioned above, what matters is the ability of the ceramic meterial in the roof portion 48 to get heated so as to adopt a very high temperature and act as a source of heat radiation with igniting properties.

In the embodiments shown in both FIGS. 2, 3 and 4 it is significant that the air inlet holes 46 are provided in different heights above the bottom of the hearth, up to a level near the lower end of the roof element 48, since some of the combustion air will be supplied to the space above the solid fuel material, i.e. to the area of the escaped combustible gases.

FIGS. 3 and 4 show elementary modifications of the cross sectional shape of the ceramic roof element 48. This element is not subjected to any special requirements other than being of a required fire resistant and heat accumulating nature. It can be made, therefore, as a full-cast or a brickworked construction whatever is the more convenient in view of the required size and shape of the element.

However, the ceramic top portion may of course be optimized in several respects. Thus, for some fuel types it is advantageous to select a particularly alkaline resistant material, and a preferred material is "Hasle 52A" (Hasle Klinker, Denmark) and "Plibrico 45S or 55S" (Plibrico, England). The material, preferably, should be heat resistant up to some 1600°–1800° C., though the temperature will not normally rise to above 800°–1300° C. The wall thickness of the material should preferably be t least 2 cm. In large units it seems advantageous to arrange for a water cooling mantle adjacent the outside of the ceramic member.

As a special precaution, the top sides of the lower hearth portion 42 should be protected against excessive heating from the ceramic member. This can be accomplished by arranging for a separation layer 52 between these parts, with the layer 52 being a so-called "vacuum board" as consisting of ceramic fibres, which are heat resistant up to some 3000° C. A layer thickness of 5–15 mm will be sufficient.

We claim:

1. A solid fuel stoker adapted to be mounted at a front of a furnace, the stoker comprising a stoker hearth and a conveyor means for supplying fuel thereto, the hearth being tunnel shaped and having combustion air inlet holes in an interior wall portion thereof, characterized in that a top portion of the hearth consists of a fire resistant ceramic material of a considerable wall thickness, and in that the combustion air inlet holes are provided solely in the lower portion of the hearth.

2. A stoker according to claim 1, wherein a highly insulating and heat resistant material layer is arranged between the ceramic top portion and top edge portions of the lower hearth portion.

3. A stoker according to claim 1, in which at least the ceramic top portion of the tunnel shaped hearth is surrounded by a water cooling mantel.

* * * * *